US009902051B2

(12) United States Patent
Hita et al.

(10) Patent No.: US 9,902,051 B2
(45) Date of Patent: Feb. 27, 2018

(54) ELECTRIC SCREWDRIVER

(71) Applicant: NITTO KOHKI CO., LTD., Tokyo (JP)

(72) Inventors: Hirokazu Hita, Tokyo (JP); Takayuki Okamoto, Tokyo (JP); Keita Moriyama, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 329 days.

(21) Appl. No.: 14/663,525

(22) Filed: Mar. 20, 2015

(65) Prior Publication Data

US 2015/0190910 A1 Jul. 9, 2015

Related U.S. Application Data

(63) Continuation of application No. PCT/JP2013/075270, filed on Sep. 19, 2013.

(30) Foreign Application Priority Data

Sep. 21, 2012 (JP) ..... 2012-207750

(51) Int. Cl.
*B25B 23/14* (2006.01)
*B25B 21/00* (2006.01)
*B25F 5/00* (2006.01)

(52) U.S. Cl.
CPC ..... *B25B 23/141* (2013.01); *B25B 21/00* (2013.01); *B25F 5/001* (2013.01)

(58) Field of Classification Search
CPC ..... B25B 23/141; B25B 21/00; B25B 23/147; B25B 23/1475; B25B 23/0035; B25F 5/001
See application file for complete search history.

(56) References Cited

U.S. PATENT DOCUMENTS 4,883,130 A 11/1989 Dixon ..... 173/12
7,201,235 B2 * 4/2007 Umemura ..... B23B 45/008 173/104

(Continued)

FOREIGN PATENT DOCUMENTS

DE 20 2005 005 513 9/2006
EP 1 477 278 11/2004

(Continued)

OTHER PUBLICATIONS

Extended European Search Report dated Jun. 8, 2016 in corresponding European Application No. 13838956.4.

(Continued)

*Primary Examiner* — David B Thomas
(74) *Attorney, Agent, or Firm* — Wenderoth, Lind & Ponack, L.L.P.

(57) ABSTRACT

Provided is a motor-driven screwdriver configured such that the upper limit value of transmittable rotational driving force differs between forward and backward rotation. The motor-driven screwdriver has a bit holder and a rotational driving force transmission device for transmitting rotational driving force to the bit holder. The rotational driving force transmission device has a driving member, a driven member having through-holes, power transmission members held in the through-holes, respectively, and an urging member urging the power transmission members inward. Each through-hole is provided such that a through-hole center axis passing through a center between a forward rotation guide surface and backward rotation guide surface of the through-hole does not intersect a rotation center axis, whereby the force with which the power transmission member is pushed radially outward is made to differ between forward and backward rotation.

3 Claims, 6 Drawing Sheets

(56) References Cited

U.S. PATENT DOCUMENTS

| | | | | |
|---|---|---|---|---|
| 7,665,392 | B2 * | 2/2010 | Tokunaga | B25B 21/00 173/178 |
| 7,669,507 | B2 * | 3/2010 | Furusawa | B25B 21/00 81/475 |
| 8,376,863 | B2 * | 2/2013 | Wernz | A61B 17/1631 464/37 |
| 8,911,320 | B2 * | 12/2014 | Tokunaga | B23D 47/12 475/159 |
| 9,016,175 | B2 * | 4/2015 | Wu | B25B 23/141 81/467 |
| 2006/0118318 | A1 * | 6/2006 | Yamada | B25B 23/141 173/178 |
| 2013/0340579 | A1 * | 12/2013 | Santamarina | B25B 15/001 81/474 |

FOREIGN PATENT DOCUMENTS

| | | |
|---|---|---|
| EP | 2 311 397 | 4/2011 |
| EP | 2 439 422 | 4/2012 |
| JP | 2-12053 | 4/1990 |
| JP | 2005-153033 | 6/2005 |
| JP | 3992676 | 10/2007 |

OTHER PUBLICATIONS

International Search Report dated Oct. 22, 2013 in corresponding International Application No. PCT/JP2013/075270.

* cited by examiner

ELECTRIC SCREWDRIVER

TECHNICAL FIELD

The present invention relates to motor-driven screwdrivers. More specifically, the present invention relates to a motor-driven screwdriver configured to transmit to a bit holder rotational driving forces different in magnitude from each other when the bit holder is to be rotated forward to tighten a screw and when the bit holder is to be rotated backward to loosen a screw.

BACKGROUND ART

A motor-driven screwdriver needs to be capable of tightening a screw with an appropriate rotational driving force because screw tightening with an excessive rotational driving force may damage the screw itself, or a member into which the screw is driven, or the motor-driven screwdriver itself. The motor-driven screwdriver is also used to loosen a tightened screw, and for this purpose, it is usually necessary to apply to the tightened screw a larger rotational driving force than that applied to tighten the screw.

FIG. 9 is a cross-sectional view of a rotational driving force transmission device 1 of a motor-driven screwdriver developed to meet the above-described technical demand, as seen toward the rear end of the motor-driven screwdriver opposite to the front end thereof provided with a screw bit. Accordingly, in the figure, counterclockwise rotation is forward rotation to tighten a screw, and clockwise rotation is backward rotation to loosen a screw.

The rotational driving force transmission device 1 has a rotational driving shaft 2 driven to rotate upon receiving rotational driving force from a driving motor, a circular cylindrical rotation output member 3 rotatable about the rotation center axis of the rotational driving shaft 2, and balls 4 held in the rotation output member 3 movably in the radial direction of the rotation output member 3 and subjected to radially inward urging force shown by the arrows 5. Rotational driving force from the rotational driving shaft 2 is transmitted to the rotation output member 3 through the balls 4, but when the rotational driving force exceeds a predetermined value, the balls 4 are pushed radially outward against the urging force 5, so that the rotational driving shaft 2 idles with respect to the rotation output member 3, thereby preventing a rotational driving force exceeding the predetermined value from being transmitted to the rotation output member 3. In addition, the rotational driving shaft 2 is shaped as shown in FIG. 9, thereby allowing the radial position for engagement of the rotational driving shaft 2 with each ball 4 to differ between backward rotation and forward rotation such that the rotational driving shaft 2 engages the ball 4 at a radially inner position during forward rotation than during backward rotation. Consequently, the proportion of the radially outward component of the force transmitted from the rotational driving shaft 2 to the balls 4 is smaller during backward rotation than during forward rotation, so that the rotational driving force required to move the balls 4 radially outward against the urging force 5 is larger during backward rotation. Accordingly, it is possible to transmit a larger rotational driving force when the rotation output member 3 is rotated backward to loosen a screw than when the rotation output member 3 is rotated forward to tighten a screw (Patent Literature 1).

FIGS. 10 and 11 show another rotational driving force transmission device 6. The rotational driving force transmission device 6 has a rotation input member 7 driven to rotate upon receiving rotational driving force from a driving motor, driving rollers 9 disposed in roller retaining portions 8, respectively, of the rotation input member 7, a circular cylindrical rotation output member 10 rotatable about the rotation center axis of the rotation input member 7, and driven balls 11 radially movably held by the rotation output member 10. The rotation output member 10 has a screwdriver bit (not shown) attached thereto. When the rotation input member 7 rotates forward (counterclockwise as seen in the figures), as shown in FIG. 10, the driving rollers 9 engage first retaining portions 8-1 of the roller retaining portions 8, respectively, and, in this state, engage the driven balls 11, respectively, to transmit rotational driving force to the rotation output member 10. When the rotation input member 7 rotates backward (clockwise as seen in the figures), as shown in FIG. 11, the driving rollers 9 engage second retaining portions 8-2 of the roller retaining portions 8, respectively, and, in this state, engage the driven balls 11, respectively, to transmit rotational driving force to the rotation output member 10. The driven balls 11 are urged toward the inside of the rotation output member, and when a force exceeding a predetermined value is applied thereto through the driving rollers 9, the driven balls 11 move outward, thereby allowing the rotation input member 7 to idle. The first retaining portion 8-1 and second retaining portion 8-2 of each roller retaining portion 8 are different in shape from each other as shown in FIGS. 10 and 11. The difference in shape allows the position for engagement of each driving roller 9 with the associated driven ball 11 to differ between forward and backward rotation such that the driving roller 9 engages the driven ball 11 at a position more away from the rotation center axis during backward rotation than during forward rotation, as in the case of the above-described example shown in FIG. 9. Accordingly, it is possible to transmit a larger rotational driving force during backward rotation than during forward rotation (Patent Literature 2).

PATENT LITERATURE

Patent Literature 1: Japanese Examined Utility Model Application Publication No. Hei 2-12053

Patent Literature 2: Japanese Patent No. 3992676

SUMMARY OF INVENTION

Technical Problem

However, the structure including a rotational driving shaft having a special shape as shown in FIG. 9 suffers from the problem that machining of the parts becomes complicated. The structure in which driving rollers move therein as shown in FIGS. 10 and 11 has the problem that the parts may wear at a high rate and may be broken particularly when forward rotation and backward rotation are repeated alternately.

Accordingly, it is an object of the present invention to provide a motor-driven screwdriver having a rotational driving force transmission device capable of solving the above-described problems.

Solution to Problem

The present invention provides a motor-driven screwdriver having a bit holder securely holding a screwdriver bit, and a rotational driving force transmission device for transmitting rotational driving force from a driving source to the bit holder to rotate the screwdriver bit forward and backward. The rotational driving force transmission device has a driving member driven to rotate about a rotation center axis upon receiving rotational driving force from the driving source, a driven member disposed around the driving member rotatably about the rotation center axis and drivably connected to the bit holder, the driven member having an outer peripheral surface and an inner peripheral surface in a radial direction with respect to the rotation center axis, the driven member further having a through-hole extending therethrough from the outer peripheral surface to the inner peripheral surface, a power transmission member movably held in the through-hole of the driven member, the power transmission member having a circular cross-section in a plane perpendicular to the rotation center axis, and an urging member urging the power transmission member inward in the radial direction so that a part of the power transmission member projects inward beyond the inner peripheral surface of the driven member. The driving member has a shaft portion extending along the rotation center axis, and a projecting portion projecting from the shaft portion outward in the radial direction toward the inner peripheral surface of the driven member. When the driving member is rotated forward and backward about the rotation center axis, the projecting portion engages the power transmission member to transmit rotational driving force from the driving member to the driven member through the power transmission member. The through-hole has a forward rotation guide surface against which the power transmission member is pressed when the driving member rotates forward and the projecting portion engages the power transmission member, and a backward rotation guide surface against which the power transmission member is pressed when the driving member rotates backward and the projecting portion engages the power transmission member. The through-hole is provided such that a through-hole center axis passing through a center between the forward rotation guide surface and the backward rotation guide surface in a plane perpendicular to the rotation center axis does not intersect the rotation center axis. When a rotational driving force exceeding a predetermined value is applied, the power transmission member is pushed by the projecting portion outward in the radial direction in the through-hole against urging force of the urging member.

According to the motor-driven screwdriver, the through-hole is provided such that the through-hole center axis does not intersect the rotation center axis, whereby the relationship between the direction in which the power transmission member is pushed by the projecting portion of the driving member and the direction in which the power transmission member moves while being guided by the guide surface can be made to differ between forward and backward rotation. Accordingly, the magnitude of pressing force applied to the urging member through the power transmission member relative to the magnitude of rotational driving force of the driving member is varied between forward and backward rotation, and thus the magnitude of rotational driving force required to push away the urging member against the urging force thereof can be made to differ between forward and backward rotation. As a result, it becomes possible to vary the magnitude of rotational driving force transmittable to the driven member between forward and backward rotation. It should be noted that the through-hole center axis corresponds to an axis of symmetry about which axial symmetry is established between hypothetical lines extending along the forward rotation guide surface and the backward rotation guide surface, respectively, in a plane perpendicular to the rotation center axis.

Preferably, the forward rotation guide surface and the backward rotation guide surface of the through-hole may be parallel to each other.

Thus, the shape of the through-hole is simplified, and it becomes possible to form the through-hole more easily.

Preferably, the respective directions of the forward rotation guide surface and the backward rotation guide surface of the through-hole may be set so that the through-hole center axis of the through-hole extends between a straight line connecting between the rotation center axis of the driving member and the center of the power transmission member and a straight line connecting between the center of the power transmission member and a point of contact between the projecting portion and the power transmission member when the driving member rotates forward and the projecting portion engages the power transmission member.

With the above-described structure, rotational driving force transmittable to the driven member can be made greater during backward rotation than during forward rotation, and it is therefore possible to transmit appropriate rotational driving forces when tightening and loosening a screw.

Specifically, the projecting portion may have an arcuate surface centered on an axis parallel to the rotation center axis, so that the arcuate surface engages the power transmission member when the driving member rotates forward and backward.

With the above-described structure, the point and angle of contact between the projecting portion and the power transmission member are relatively identical as seen from the rotation center axis during forward and backward rotation. Therefore, the magnitudes of rotational driving forces transmittable to the driven member during forward and backward rotation can be easily set only by adjusting the inclination of the forward and backward rotation guide surfaces of the through-hole.

More specifically, the shaft portion may have a circular cylindrical outer peripheral surface centered on the rotation center axis, and the projecting portion may have an arcuate outer peripheral surface extending parallel to the rotation center axis.

Even more specifically, the projecting portion may be formed by a circular columnar member that is partially embedded in the circular cylindrical outer peripheral surface of the shaft portion so as to extend parallel to the rotation center axis, the circular columnar member having a portion projecting from the circular cylindrical outer peripheral surface toward the inner peripheral surface of the driven member to form the arcuate outer peripheral surface.

Preferably, the power transmission member may have a spherical shape.

With a spherical shape, the power transmission member can move smoothly when the rotational driving force exceeds a predetermined value.

Preferably, the urging member may comprise a taper ring having a tapered surface abutting against the power transmission member, and a spring pressing the taper ring in a direction parallel to the rotation center axis so that the tapered surface urges the power transmission member inward in the radial direction.

More preferably, the arrangement may be as follows. When the power transmission member is pushed outward in the radial direction, the taper ring moves against the spring, and a stop switch for stopping the driving source is activated in response to movement of the taper ring.

Because the driving source stops when a rotational driving force exceeding a predetermined value is applied, no excessive load will be applied to a screw or the like, and it is possible to prevent a failure of the motor-driven screwdriver itself, and to ensure safety for the user.

DESCRIPTION OF EMBODIMENTS

Figure 1:
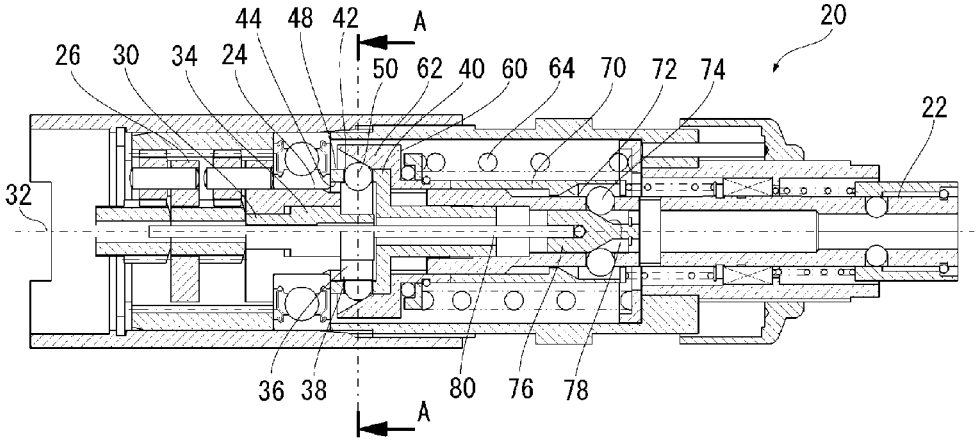
FIG. 1 is a sectional side view of a motor-driven screwdriver according to the present invention.

As shown in FIG. 1, a motor-driven screwdriver 20 according to the present invention has a bit holder 22 securely holding a screwdriver bit (not shown; inserted from the right end as seen in the figure), and a rotational driving force transmission device 24 for transmitting rotational driving force from a driving motor (not shown) as a driving source (installed at the left end as seen in the figure) to the bit holder 22. Rotational driving force from the driving motor is transmitted to the rotational driving force transmission device 24 through a speed reducer 26.

Figure 2:
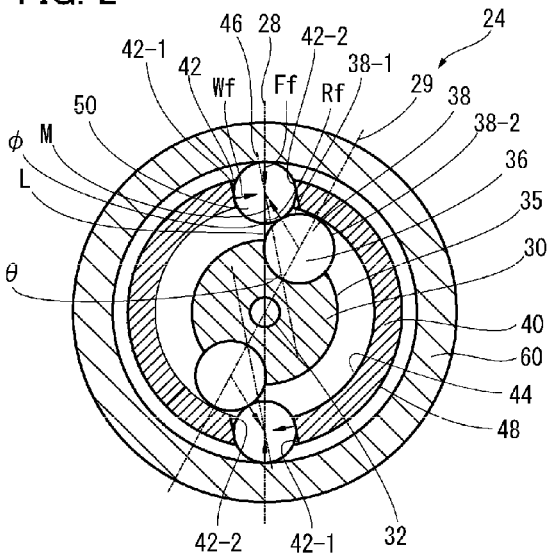
FIG. 2 is a sectional view seen along the line A-A in FIG. 1, showing a rotational driving force transmission device during forward rotation (counterclockwise rotation as seen in the figure).
Figure 5:
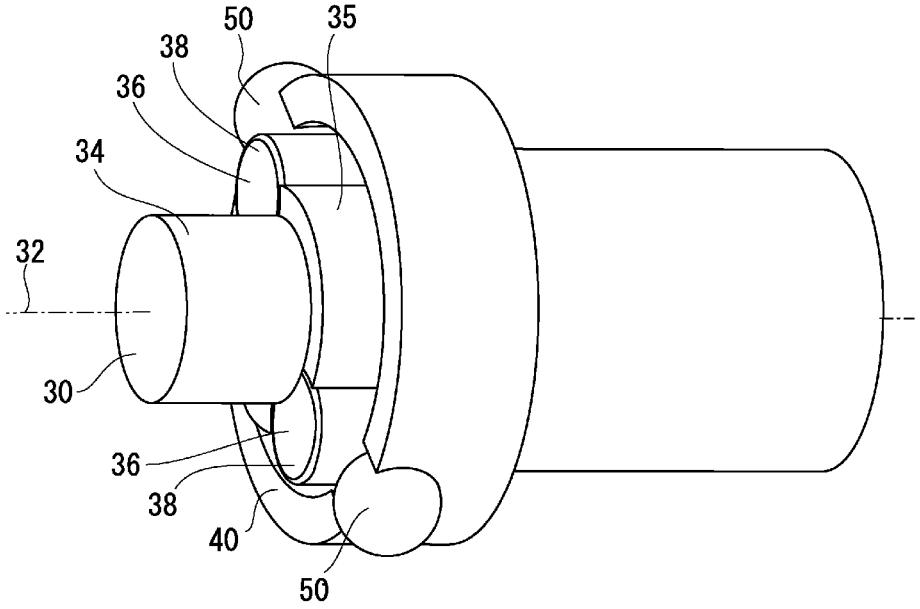
FIG. 5 is a partially-sectioned perspective view showing an important part of the rotational driving force transmission device, which is partially cut away to clarify the relationship between a shaft portion of a driving member, circular columnar members (projecting portions) partially embedded in the shaft portion, spherical power transmission members, and a driven member holding the power transmission members.

As shown in FIG. 2, the rotational driving force transmission device 24 has a driving member 30 driven to rotate about a rotation center axis 32 upon receiving rotational driving force from the driving motor, a driven member 40 disposed around the driving member 30 rotatably about the rotation center axis 32 and drivably connected to the bit holder 22, power transmission members 50 movably held in respective radially extending circular cylindrical through-holes 42 provided in the driven member 40, and an urging member 60 positioning the power transmission members 50 so that a part of each power transmission member 50 projects inward beyond an inner peripheral surface 44 of the driven member 40. The urging member 60 urges the power transmission members 50 inward when the power transmission members 50 are pushed radially outward. As will be understood from FIG. 5, the power transmission members 50 are spherical in shape.

The driving member 30 comprises a shaft portion 34 extending along the rotation center axis 32 and circular columnar members 36 partly embedded in a circular cylindrical outer peripheral surface 35 near the front end of the shaft portion 34. Each columnar member 36 extends with its longitudinal direction parallel to the rotation center axis 32 and is secured with a part thereof embedded in the shaft portion 34. The rest of each columnar member 36 projects from the cylindrical outer peripheral surface 35 of the shaft portion 34 to form a projecting portion 38. When the driving member 30 rotates about the rotation center axis 32 forward (counterclockwise as seen in the figures) to tighten a screw and backward (clockwise as seen in the figures) to loosen a screw, the projecting portions 38 engage the power transmission members 50, respectively, held in the through-holes 42 of the driven member 40, thereby transmitting rotational driving force from the driving member 30 to the driven member 40 through the power transmission members 50.

Figure 3:
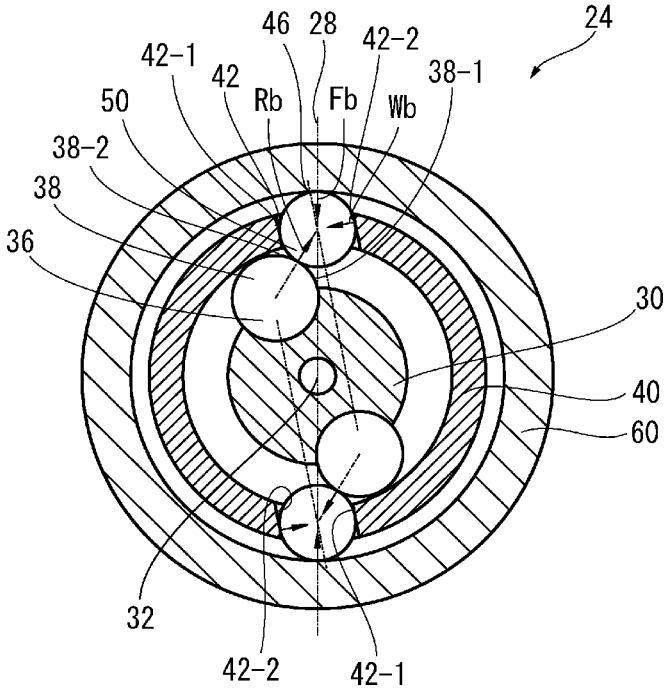
FIG. 3 is a sectional view seen along the line A-A in FIG. 1, showing the rotational driving force transmission device during backward rotation (clockwise rotation as seen in the figure).

The through-holes 42 each have a forward rotation guide surface 42-1 against which the associated power transmission member 50 is pressed when the driving member 30 rotates forward and the projecting portions 38 engage the power transmission members 50, respectively, as shown in FIG. 2, and a backward rotation guide surface 42-2 against which the associated power transmission member 50 is pressed when the driving member 30 rotates backward and the projecting portions 38 engage the power transmission members 50, respectively, as shown in FIG. 3. The forward rotation guide surface 42-1 and the backward rotation guide surface 42-2 are provided parallel to each other. The direction of each through-hole 42 is set so that a through-hole center axis 46 defined as a center line passing through a center between the forward rotation guide surface 42-1 and the backward rotation guide surface 42-2 in a plane perpendicular to the rotation center axis 32 does not intersect the rotation center axis 32 (alternatively, the through-hole center axis 46 may be defined as an axis of symmetry about which axial symmetry is established between hypothetical lines extending along the forward rotation guide surface 42-1 and the backward rotation guide surface 42-2, respectively, in a transverse plane perpendicular to the rotation center axis 32). The reason for this is as follows. By configuring each through-hole 42 such that the way in which the through-hole surface receives the associated power transmission member 50 when subjected to rotational driving force from the driving member 30 differs between forward and backward rotation, the force that the urging member 60 receives through the power transmission member 50 is made to differ between forward and backward rotation for the same magnitude of rotational driving force, thereby allowing the magnitude of transmittable rotational driving force to differ between forward and backward rotation. This will be explained below in detail.

As shown in FIG. 2, when the driving member 30 rotates forward, a forward rotation engagement surface 38-1 on the outer surface of each columnar member 36 engages the associated power transmission member 50 projecting from the inner peripheral surface 44 of the driven member 40, thereby applying a force shown by the arrow $R_f$ to the power transmission member 50. Simultaneously, the power transmission member 50 is urged radially inward by the urging member 60 with a force shown by the arrow $F_f$. The power transmission member 50 engaged with the driving member 30 is also pressed against the forward rotation guide surface 42-1 of the through-hole 42; accordingly, a force shown by the arrow $W_f$ is applied to the power transmission member 50 as a reaction force from the forward rotation guide surface 42-1.

As shown in FIG. 3, when the driving member 30 rotates backward, a backward rotation engagement surface 38-2 on the outer surface of each columnar member 36 engages the associated power transmission member 50 to apply a force shown by the arrow $R_b$ to the power transmission member 50. To the power transmission member 50 are also applied a force shown by the arrow $F_b$ from the urging member 60 and a force shown by the arrow $W_b$ from the backward rotation guide surface 42-2 of the through-hole 42, as in the case of the forward rotation of the driving member 30.

Figure 4:
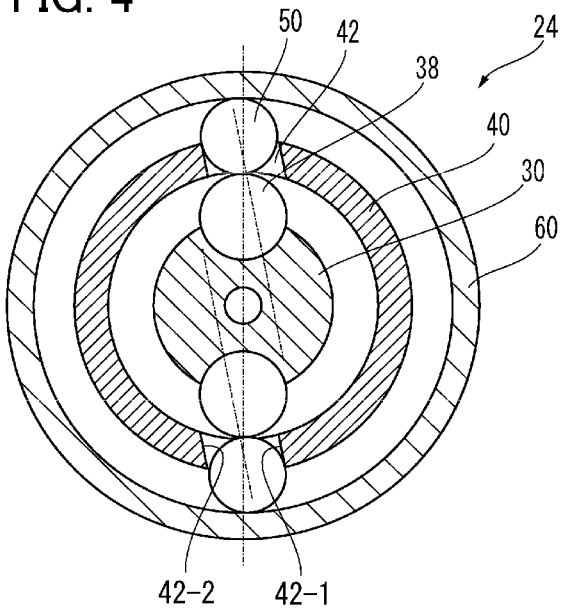
FIG. 4 is a sectional view seen along the line A-A in FIG. 1, showing the rotational driving force transmission device when power transmission members are pushed outward.

When the driving member 30 is rotating forward or backward, while the rotational driving force from the driving member 30 is not greater than a predetermined magnitude, the force with which each projecting portion 38 of the driving member 30 pushes the associated power transmission member 50 outward is smaller than the force with which the urging member 60 can push the power transmission member 50 inward; therefore, the power transmission member 50 does not move radially. Accordingly, the engagement between the driving member 30 and the power transmission member 50 is maintained, and hence the rotational driving force of the driving member 30 is transmitted to the driven member 40 by $W_f$ or $W_b$ to rotate the bit holder 22 with the rotational driving force. However, when the rotational driving force from the driving member 30 exceeds the predetermined magnitude, the force with which the driving member 30 pushes the power transmission member 50 outward becomes greater than the force with which the urging member 60 pushes the power transmission member 50 inward, and the power transmission member 50 is pushed outward against the urging force of the urging member 60. Consequently, as shown in FIG. 4, the projecting portion 38 of the driving member 30 passes across the position where the power transmission member 50 is provided, and idles with respect to the driven member 40; therefore, any rotational driving force greater than the predetermined magnitude cannot be transmitted to the driven member 40. Thus, the motor-driven screwdriver 20 limits, to a predetermined magnitude, the rotational driving force transmittable to the bit holder 22 drivably connected to the driven member 40.

Each through-hole 42, which is provided in the driven member 40 to extend therethrough from the outer peripheral surface 48 to the inner peripheral surface 44, is configured such that the through-hole center axis 46 does not intersect the rotation center axis 32, as has been stated above. Assuming that an angle $\phi$ is an angle between a straight line L connecting between the rotation center axis 32 of the driving member 30 and the center of the power transmission member 50 and a straight line M connecting between the center of the power transmission member 50 and a point of contact between the projecting portion 38 and the power transmission member 50 when the projecting portion 38 is engaged with the power transmission member 50 (FIG. 2) during forward rotation of the driving member 30, an angle $\theta$ between the straight line L and the through-hole center axis 46 is preferably set smaller than the angle $\phi$ ($\theta<\phi$).

Now, let us make a comparison in magnitude between rotational driving force $T_f$ during forward rotation when the power transmission member 50 is pushed outward of the driven member 40 along the forward rotation guide surface 42-1 and rotational driving force $T_b$ during backward rotation when the power transmission member 50 is pushed outward of the driven member 40 along the backward rotation guide surface 42-2. Assuming that $R_f$ represents the force applied to the power transmission member 50 when the rotational driving force $T_f$ is generated in the driving member 30 during forward rotation, and that $F_f$ represents the urging force of the urging member 60 during the forward rotation, the equation of equilibrium of force in the direction of the forward rotation guide surface 42-1 (i.e. in the direction of the through-hole center axis 46) is as follows:

$$R_f \cos(\phi-\theta)=F_f \cos\theta \quad (1)$$

Assuming that $R_b$ represents the force applied to the power transmission member 50 when the rotational driving force $T_b$ is generated in the driving member 30 during backward rotation, and that $F_b$ represents the urging force of the urging member 60 during the backward rotation, the equation of equilibrium of force in the direction of the backward rotation guide surface 42-2 (i.e. in the direction of the through-hole center axis 46) is as follows:

$$R_b \cos(\phi+\theta)=F_b \cos\theta \quad (2)$$

Here, the urging force of the urging member 60 is the same during forward and backward rotation as follows:

$$F_f=F_b=F \quad (3)$$

Therefore, from the above expressions (1) to (3), we obtain the following:

$$R_f \cos(\phi-\theta)=R_b \cos(\phi+\theta) \quad (4)$$

$$R_f/R_b=\cos(\phi+\theta)/\cos(\phi-\theta)<1)\ (0<\phi-\theta<\phi+\theta<90°) \quad (5)$$

$$R_f<R_b \quad (6)$$

The relation between the rotational driving force $T_f$ and the force $R_f$ during the forward rotation may be expressed as follows by using a constant C:

$$T_f=CR_f(7)$$

Here, the magnitude of force applied to the power transmission member 50 by the rotational driving force varies according to both the distance between the rotation center axis 32 and the point of contact between the projecting portion 38 and the power transmission member 50 and the direction of the rotational driving force. In this regard, however, the point and angle of contact between the projecting portion 38 and the power transmission member 50 are symmetric about a radial axis 28 between forward and backward rotation. Therefore, the distance between the rotation center axis 32 and the point of contact is the same during forward and backward rotation. Moreover, the direction of the force is symmetric about the radial axis 28 between forward and backward rotation. Therefore, the relation between the rotational driving force $T_b$ and the force $R_b$ during backward rotation can be expressed as follows in the same way as during forward rotation:

$$T_b = CR_b \quad (8)$$

Therefore, from the expressions (6) to (8), we can derive the following relation:

$$T_f < T_b \quad (9)$$

That is, the rotational driving force required to push the power transmission member 50 outward of the driven member 40 is greater during backward rotation than during forward rotation. In the motor-driven screwdriver 20, the rotational driving force transmittable to loosen a screw is greater than that to tighten a screw. It should be noted that the difference in rotational driving force between forward and backward rotation can be set as desired by adjusting the degree of inclination of the forward rotation guide surface 42-1 and the backward rotation guide surface 42-2, i.e. the degree (angle θ) of inclination of the through-hole center axis 46, as will also be understood from the expression (5).

Thus, the motor-driven screwdriver 20 according to the present invention is configured to allow the transmittable rotational driving force to differ in magnitude between forward and backward rotation by obliquely forming the forward rotation guide surface 42-1 and the backward rotation guide surface 42-2, which guide the associated power transmission member 50, and does not require the projecting portions 38 of the driving member 30 to be formed into a complicated shape. Therefore, the parts can be made relatively simple in shape.

Figure 6:
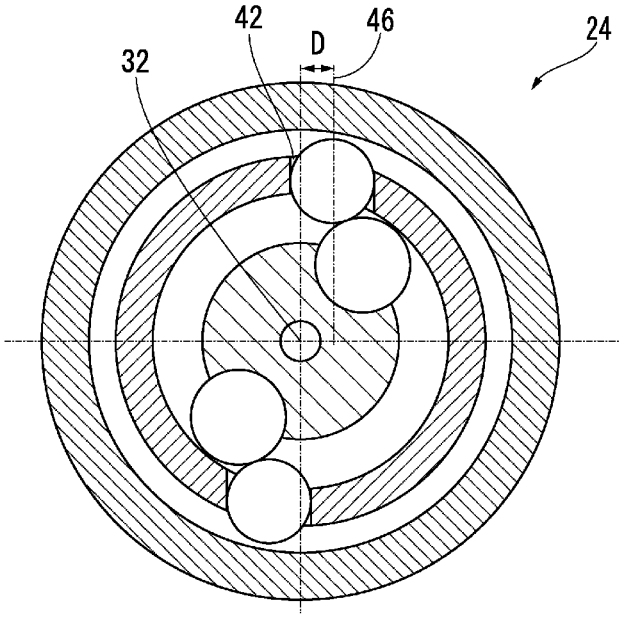
FIG. 6 is a diagram obtained by rotating FIG. 3 slightly clockwise so that the center axes of through-holes provided in the driven member are parallel to a line perpendicularly passing through the rotation center axis of the driving member.

Although in the foregoing description the through-hole 42 is formed such that the through-hole center axis 46 is inclined by an angle θ, it should be noted that the through-hole 42 may be formed, as shown in FIG. 6, which is a drawing obtained by slightly rotating FIG. 2 clockwise. That is, the through-hole 42 may be formed such that the through-hole center axis 46 is displaced parallel by a distance D from a line extending perpendicularly through the rotation center axis 32 of the driving member 30, which results in a configuration similar to the above. In actual manufacturing process, it may be often easier to set a distance D from the center and to form the through-hole 42 perpendicularly at a position displaced by the distance D from the center than to set an amount of inclination and to obliquely form the through-hole 42 by cutting or the like.

Figure 7:
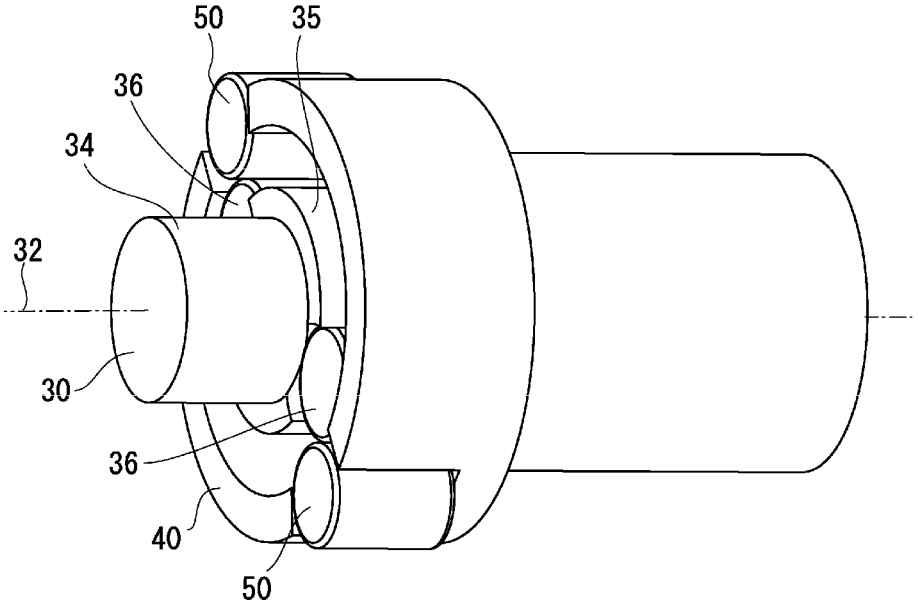
FIG. 7 is a partially-sectioned perspective view similar to FIG. 5, showing an important part of a rotational driving force transmission device according to another embodiment.

The power transmission members 50 may have, besides a spherical shape, any other shape having a circular cross-section in a plane perpendicular to the rotation center axis 32. For example, the power transmission members 50 may be circular cylindrical members disposed such that the longitudinal axes thereof are parallel to the rotation center axis 32, as shown in FIG. 7.

Figure 8:
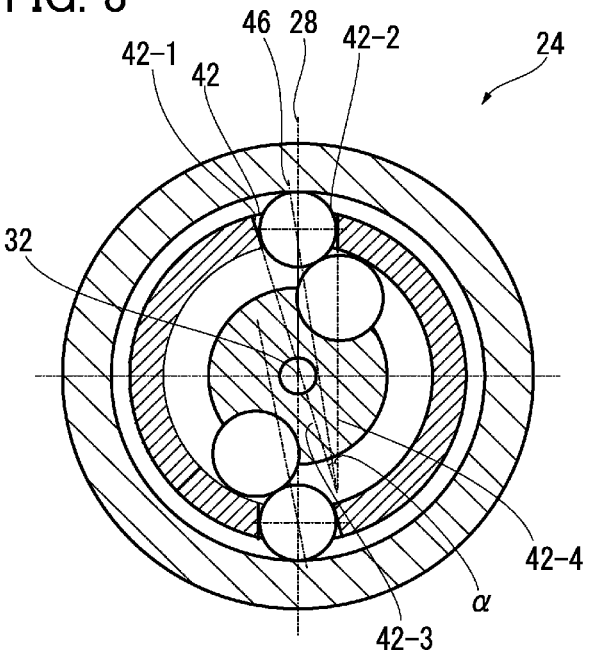
FIG. 8 is a sectional view showing the rotational driving force transmission device according to the another embodiment.
Figure 9:
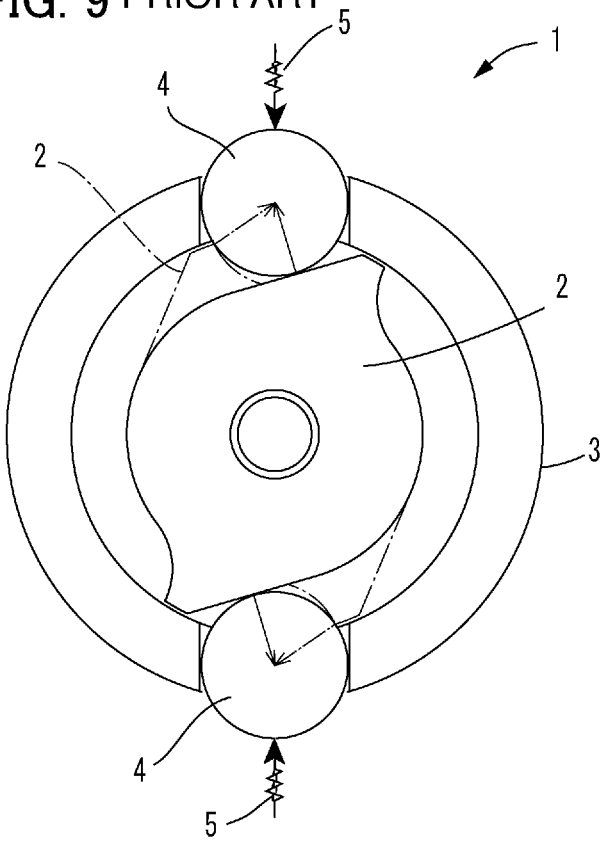
FIG. 9 PRIOR ART
FIG. 9 is a sectional view of a rotational driving force transmission device of a conventional motor-driven screwdriver, in which the one-dot chain lines show a rotational driving shaft engaging balls during backward rotation (clockwise rotation as seen in the figure), and the solid lines show the rotational driving shaft engaging the balls during forward rotation (counterclockwise rotation as seen in the figure).
Figure 10:
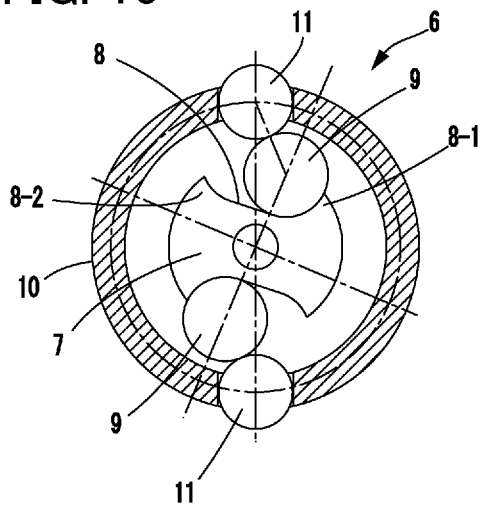
FIG. 10 PRIOR ART
FIG. 10 is a sectional view showing a rotational driving force transmission device of another conventional motor-driven screwdriver during forward rotation.
Figure 11:
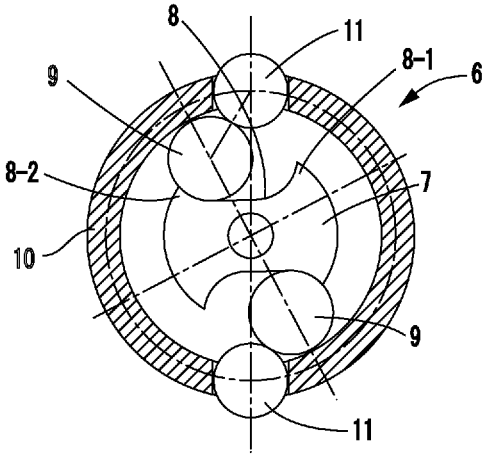
FIG. 11 PRIOR ART
FIG. 11 is a sectional view showing the rotational driving force transmission device of the other conventional motor-driven screwdriver during backward rotation.

Further, the through-holes 42 may be tapered holes, as shown in FIG. 8, in which the forward rotation guide surface 42-1 and the backward rotation guide surface 42-2 are not parallel to each other. In this case, the through-hole center axis 46 (i.e. an axis extending in the longitudinal direction of the through-hole through the center of the transverse section of the through-hole) is defined as a bisector bisecting an angle α formed by extended lines 42-3 and 42-4 of the forward rotation guide surface 42-1 and the backward rotation guide surface 42-2 in a plane perpendicular to the rotation center axis 32, and thus the through-hole center axis 46 does not intersect the rotation center axis 32. With this configuration, the respective directions of the forward and backward rotation guide surfaces 42-1 and 42-2 of the through-hole 42 can be set independently of each other; therefore, rotational driving forces transmittable during forward and backward rotation can be set with a higher degree of freedom.

The urging member 60 comprises, as shown in FIG. 1, a taper ring 62 and a spring 64. The taper ring 62 has a tapered surface which engages the power transmission members 50, so that, when the power transmission members 50 are pushed outward, a rightward (as seen in the figure) force is applied to the taper ring 62 from the power transmission members 50. The spring 64 urges the taper ring 62 leftward (as seen in the figure) in the direction of the rotation center axis 32 to maintain, in the radial axis direction, the positions of the power transmission members 50 pushed by the projecting portions 38 of the driving member 30. When a rotational driving force exceeding a predetermined value is applied, as has been stated above, the power transmission members 50 move outward along the through-hole center axis 46 while pushing the taper ring 62 rightward in the direction of the rotation center axis 32 against the urging force of the spring 64. Consequently, an inclined surface 72 of a circular cylindrical member 70 presses balls 74 radially inward, and this causes an inclined surface 78 of a pilot pin holding member 76 to be pushed, which in turn pushes a pilot pin 80 leftward. The movement of the pilot pin 80 actuates a start switch of the driving motor to stop the driving motor. Stopping the driving motor in this way prevents the driving member from continuing to idle when a rotational driving force exceeding a predetermined value is generated, and it is therefore possible to reduce excess load on a screw or the like and to ensure safety for the user.

In this embodiment, the projecting portions 38 of the driving member 30 are formed by embedding the columnar members 36, which are separate members, in the circular cylindrical outer peripheral surface 35 of the shaft portion 34, but the projecting portions 38 may be formed integrally with the shaft portion 34. Further, although the outer surface of each projecting portion 38 is arcuate, the projecting portion 38 may have an outer surface with a shape other than a circular arc, provided that the forward rotation engagement surface 38-1 and the backward rotation engagement surface 38-2 are symmetric about a radial axis 29 extending through the projecting portion 38. Alternatively, the outer surface of the projecting portion 38 may have any asymmetric shape about the radial axis 29.

LIST OF REFERENCE SIGNS

20: motor-driven screwdriver
22: bit holder
24: rotational driving force transmission device
26: speed reducer
28: radial axis
29: radial axis
30: driving member
32: rotation center axis
34: shaft portion
35: circular cylindrical outer peripheral surface
36: circular columnar member
38: projecting portion
38-1: forward rotation engagement surface
38-2: backward rotation engagement surface
40: driven member
42: through-hole
42-1: forward rotation guide surface
42-2: backward rotation guide surface
42-3: extended line
42-4: extended line
44: inner peripheral surface
46: through-hole center axis
48: outer peripheral surface

50: power transmission member
60: urging member
62: taper ring
64: spring
70: circular cylindrical member
72: inclined surface
74: ball
76: pilot pin holding member
78: inclined surface
80: pilot pin

The invention claimed is:

1. A motor-driven screwdriver comprising a bit holder securely holding a screwdriver bit, and a rotational driving force transmission device for transmitting rotational driving force from a driving source to the bit holder to rotate the screwdriver bit forward and backward;

the rotational driving force transmission device comprising:

a driving member driven to rotate about a rotation center axis upon receiving rotational driving force from the driving source;

a driven member disposed around the driving member rotatably about the rotation center axis and drivably connected to the bit holder, the driven member having an outer peripheral surface and an inner peripheral surface in a radial direction with respect to the rotation center axis, the driven member further having a through-hole extending therethrough from the outer peripheral surface to the inner peripheral surface;

a power transmission member movably held in the through-hole of the driven member, the power transmission member having a circular cross-section in a plane perpendicular to the rotation center axis; and an urging member urging the power transmission member inward in the radial direction so that a part of the power transmission member projects inward beyond the inner peripheral surface of the driven member;

the driving member having a shaft portion extending along the rotation center axis, and a projecting portion projecting from the shaft portion outward in the radial direction toward the inner peripheral surface of the driven member, wherein, when the driving member is rotated forward and backward about the rotation center axis, the projecting portion engages the power transmission member to transmit rotational driving force from the driving member to the driven member through the power transmission member;

the through-hole having a forward rotation guide surface against which the power transmission member is pressed when the driving member rotates forward and the projecting portion engages the power transmission member, and a backward rotation guide surface against which the power transmission member is pressed when the driving member rotates backward and the projecting portion engages the power transmission member, the through-hole being provided such that a through-hole center axis thereof extending along a center line between the forward rotation guide surface and the backward rotation guide surface in a plane perpendicular to the rotation center axis does not intersect the rotation center axis;

wherein, when a rotational driving force exceeding a predetermined value is applied, the power transmission member is pushed by the projecting portion outward in the radial direction in the through-hole against urging force of the urging member, wherein respective directions of the forward rotation guide surface and the backward rotation guide surface of the through-hole are set so that the through-hole center axis of the through-hole extends between a straight line connecting between the rotation center axis of the driving member and a center of the power transmission member and a straight line connecting between the center of the power transmission member and a point of contact between the projecting portion and the power transmission member when the driving member rotates forward and the projecting portion engages the power transmission member, wherein the projecting portion has an arcuate surface centered on an axis parallel to the rotation center axis, so that the arcuate surface engages the power transmission member when the driving member rotates forward and backward, wherein the shaft portion has a circular cylindrical outer peripheral surface centered on the rotation center axis, the projecting portion being configured such that the arcuate surface extends parallel to the rotation center axis and projects outward in the radial direction from the circular cylindrical outer peripheral surface, wherein the projecting portion is formed by a circular columnar member that is partly embedded in the circular cylindrical outer peripheral surface of the shaft portion so as to extend parallel to the rotation center axis, the circular columnar member having a portion projecting from the circular cylindrical outer peripheral surface toward the inner peripheral surface of the driven member to form the arcuate surface, wherein the power transmission member has a spherical shape, and wherein the urging member comprises a taper ring having a tapered surface abutting against the power transmission member, and a spring pressing the taper ring in a direction parallel to the rotation center axis so that the tapered surface urges the power transmission member inward in the radial direction.

2. The motor-driven screwdriver of claim 1, wherein the forward rotation guide surface and the backward rotation guide surface of the through-hole are parallel to each other.

3. The motor-driven screwdriver of claim 1, wherein, when the power transmission member is pushed outward in the radial direction, the taper ring moves against the spring, and a stop switch for stopping the driving source is activated in response to movement of the taper ring.

* * * * *